United States Patent [19]

Kyle

[11] 4,160,564

[45] Jul. 10, 1979

[54] CONVERTABLE CHAIR

[76] Inventor: Gordon L. Kyle, 211 Great Neck Rd., Waterford, Conn. 06385

[21] Appl. No.: 907,594

[22] Filed: May 19, 1978

[51] Int. Cl.[2] ..... A47C 3/02; A47C 13/00

[52] U.S. Cl. ..... 297/131; 297/270

[58] Field of Search ..... 297/130, 131, 132, 258, 297/355, 354, 270

[56] References Cited

U.S. PATENT DOCUMENTS

| | | | |
|---|---|---|---|
| 480,636 | 8/1892 | Stevens | 297/132 |
| 514,403 | 2/1894 | Allen | 297/355 |
| 637,706 | 11/1899 | Brown | 297/441 X |
| 685,509 | 10/1901 | Dutton | 297/131 X |
| 1,026,276 | 5/1912 | Moskowits | 297/131 |
| 3,269,771 | 8/1966 | Erdos | 297/132 |

FOREIGN PATENT DOCUMENTS

| | | | |
|---|---|---|---|
| 528179 | 11/1928 | Fed. Rep. of Germany | 297/131 |

*Primary Examiner*—James T. McCall

*Attorney, Agent, or Firm*—Mark H. Jay

[57] ABSTRACT

A chair has two vertical side pieces connected by three horizontally elongated struts. A back piece is connected between the struts and extends upwardly therefrom. A seat piece is connected between the side pieces. When adjusted in one position, the seat piece engages the first and second strut and supports the chair in a stationary position on the side pieces and the seat pieces. When adjusted to another position, the seat piece engages the first strut and the third strut and allows the chair to be supported only on the side pieces, on their curved lower edges. Thus, the chair may rock back and forth on the side pieces.

7 Claims, 5 Drawing Figures

CONVERTABLE CHAIR

BACKGROUND OF THE INVENTION

Chairs that convert from rocking chairs to stationary ones are known in the art. However, this invention makes use of a movable seat piece in conjunction with two side pieces in a unique fashion previously unknown in the art, wherein the seat piece can either serve as part of the supporting structure of the chair or not, as the case may be, in order to accomplish the conversion.

SUMMARY OF INVENTION

This invention is directed towards the production of a chair which may be adjusted for use as a stationary chair or as a rocking chair.

In this invention, the movement of one unitary piece (denoted the seat piece) between two positions converts the chair into a rocking chair from a stationary chair and vice versa. When the seat piece is in one position, it helps to support the chair on the floor. When the seat piece is in another position, it remains free of the floor and allows other portions of the device to support the chair on curved lower surfaces, on which surfaces the chair can rock back and forth.

DETAILED DESCRIPTION OF PREFERRED EMBODIMENTS

Figure 1:
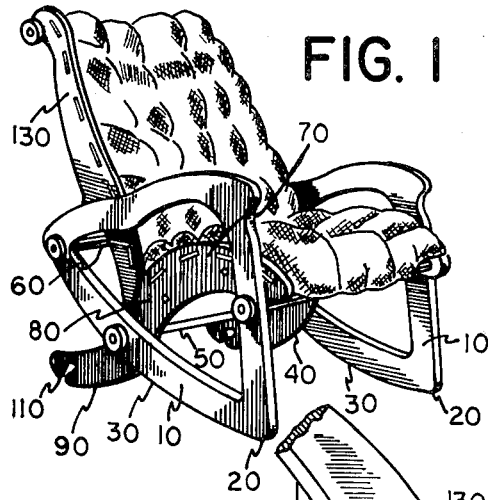
FIG. 1 shows the invention adjusted to a stationary chair position.

Two like side pieces 10 are located parallel to each other in vertical planes. Each side piece has a front corner 20 which will touch the ground when the chair is adjusted to a stationary chair position, and also has a curved lower edge 30 which will rock back and forth on the ground when the chair is adjusted to a rocking chair position. These two side pieces are generally triangular in shape. Although they are shown to have their centers cut out in the drawings, they may be solid in the center without losing any of their function in the device, and their open centers as appearing herein are not intended to limit the invention.

These side pieces are secured together by a first strut 40, a second strut 50 and a third strut 60. For the time being, these struts will be described only as parallel, horizontal and elongated bar-like pieces, being in each case located between and attached to corresponding points of the side pieces. The first strut is attached to the midpoint of one side of each side piece above the front corner; the second strut is attached rearwardly of the midpoint of the curved side of each side piece; and the third strut is attached to the rear end of each curved side of each side piece at the end remote from the front corner. Each of these three struts have a specific function which determines its shape. As will be seen hereinafter, the front portion of the seat piece will always rest upon the top of the first strut, while the middle and rear portions of the seat piece will, respectively, engage either the second or third struts, depending upon whether the chair is to be adjusted to a stationary position or a rocking position.

As to this seat piece, it is formed from two like, parellel and vertically oriented members, each of which assumes the shape of a prolonged elongated and flattened S. The front portion 70 of each member always extends rearwardly in a generally horizontal direction, the middle portion 80 extends downwardly and rearwardly, and the rear portion 90 extends rearwardly in a generally horizontal direction. In each middle portion, a second notch 100 extends downwardly into and through the member from the top; and in each rear portion a third notch 110 extends upwardly into and through the member. The two members are connected together to form the unitery seat piece by transverse struts 120.

It can now be seen that the seat piece and the side pieces form a frame with an adjustable configuration. In one configuration, the second notches engage the second strut. In this configuration, the rear portions of the seat piece and the front corners of the side pieces support the frame in a stationary position where four points touch the floor. In the other configuration, the third notches engage the third strut. In this latter configuration, the seat piece is raised off the floor entirely and the frame is supported by the curved edges of the side pieces. Hence, the frame is only supported at two points, and the frame can rock back and forth along the lower edges. Thus, this frame provides an adjustable support for a chair. In one position, a rocking chain is formed, while in another, a stationary chair is formed.

A back piece is formed by two like members 130. These members are vertically elongated and are located parallel to each other and to the side pieces. These members are attached together by a rod 140 at their top ends and by the second strut at their bottom ends. Because the second strut is not tightly fitted through holes in the members 130, the whole back piece can pivot about the second strut, allowing the angle of inclination of the back piece relative to the seat piece to be adjusted. In order to adjust the back piece to the position desired, the mechanism detailed in FIG. 3 is employed.

Figure 3:
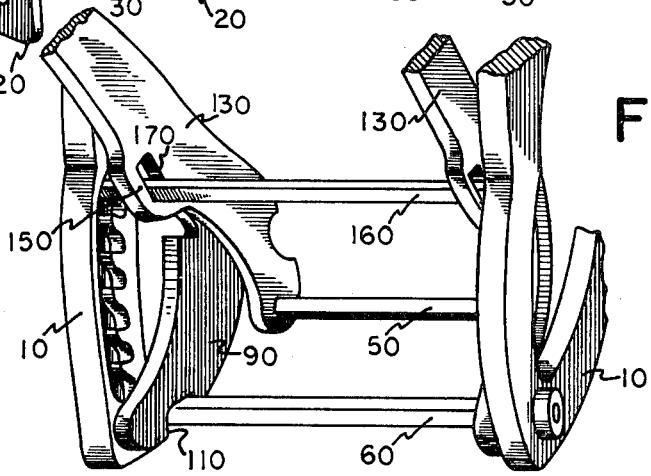
FIG. 3 is a rear detail view of a portion of the invention.
Figure 4:
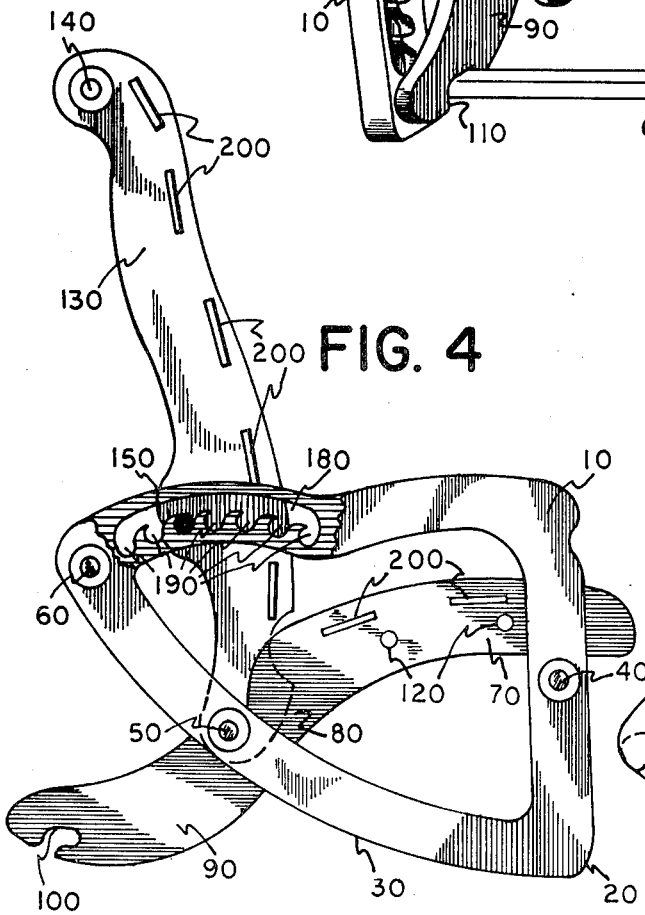
FIG. 4 is a partially cut away side view of the invention adjusted to the stationary chair position.
Figure 5:
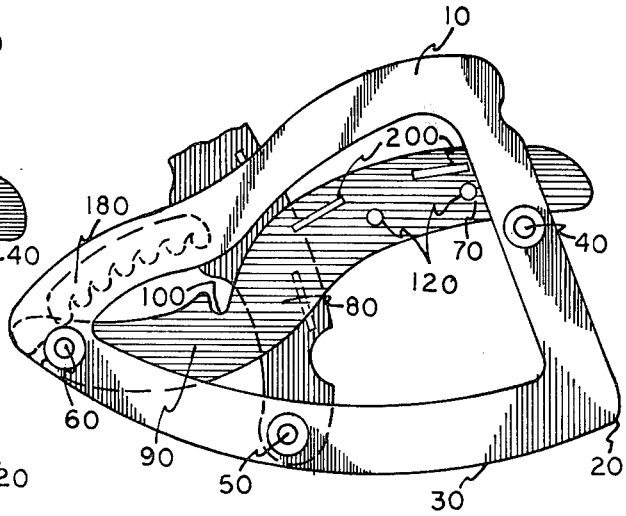
FIG. 5 is a partially cut away side view of the invention adjusted to the rocking chair position.

FIG. 3 shows that each member 130 has a portion 150 that extends rearwardly from the rear of the member, just above the member's lower end. A bar 160 rides in elongated first slots 170 in corresponding portions 150 in such a manner that the bar can be lifted up or allowed to drop down. The bar engages second slots 180 cut into the inside of each side piece at its ends. Each of the second slots has downwardly extending notches 190 contiguous with it. It can be seen that when the bar is lifted up, so that its ends are free to slide in slots 180, that the back piece will be free to pivot on the second strut, and to be raised or reclined as the user desires. When the bar is allowed to drop so that its ends engage one of the sets of notches, the position of the back piece is fixed. It will be also noted that this adjustability feature is independent of the position of the seat piece, so that the back piece is adjustable regardless of the adjustment of the chair into a stationary chair or a rocking chair.

At this point it is appropriate to note that the struts and bar that secure the various elements of the device together are here shown to be threaded at their ends, engaging correspondingly threaded nuts. This particular embodiment is not designed to be interpreted restrictively—any suitable method of connection may be used.

It is also appropriate to note that the struts have different shapes. Between the side pieces, the first strut is entirely square in cross-section, since its only function is to support the seat piece. The ends of the second strut are cylindrical adjacent the seat pieces for the width of the portions 80, to allow engagement of the seat piece with the strut, and are further cylindrical for the width of members 130, to allow the back piece to pivot. Finally, the ends of the third strut are cylindrical adjacent the side pieces for the width of the side pieces, in order to allow the engagement of notches 110 with the third strut.

Figure 2:
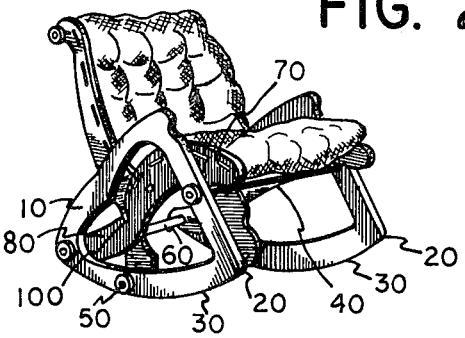
FIG. 2 shows the invention adjusted to a rocking chair position.

Fabric loops 200 are located between the sides of the back piece and the sides of the seat piece at the top and rear, respectively. These loops provide two platforms, one at the top of the back piece and one at the front of the side piece, which platforms can support a cushion such as is shown in FIGS. 1 and 2. In the drawings, the cushion is shown to be a single elongated rectangle hanging off bar 140, but, as before, this embodiment is not intended to be restrictive. It can be seen that the platform on the back piece and on the seat piece form an L when viewed from the side, with the angle of the L being variable with the position of the back piece.

What is claimed is:

1. An adjustable chair which can be adjusted to serve as a rocking chair when desired and as a stationary chair when desired, comprising:

a frame having two like parellel and vertically oriented side pieces, each side piece having a curved lower edge that always touches a floor;

an elongated and generally rectangular back piece with a generally rectangular platform at its top connected between the side pieces and extending generally upwardly therefrom; and an elongated seat piece with a generally square platform in its front located between the side pieces in a generally horizontal orientation and being adjustable between a rocking chair position and a stationary chair position, with the seat piece being suspended from the floor and allowing the chair to rock on the curved lower edges of the side pieces when the seat piece is in the rocking chair position and with the seat piece touching the floor at its end remote from the platform and supporting the chair along with the side pieces when the seat piece is adjusted to the stationary chair position, the rectangular platform and the square platform always being so disposed that they form a surface which is generally L-shaped in side view to support a cushion.

2. The device of claim 1 wherein the two side pieces are secured together by a first strut, a second strut and a third strut, all of which struts are like horizontally elongated and parallel.

3. The device of claim 2 wherein the seat piece rests upon the first strut and engages the second strut when the seat piece is adjusted to the stationary chair position and wherein the seat piece rests upon the first strut and engages the third strut when the seat piece is adjusted to the rocking chair position.

4. The device of claim 3 wherein the second and third struts are secured between the side pieces just above their curved edges.

5. The device of claim 4 further including a means cooperating with the back piece and the side pieces to allow the angle of the back piece with respect to the side pieces to be varied.

6. The device of claim 5 wherein the bottom of the back piece is pivotally secured to the second strut, and wherein the degree of pivoting is determined by the means.

7. The device of claim 6 wherein the means includes a bar extending through the back piece and being removably locatable in a plurality of recessed slots located in the side pieces.

* * * * *